United States Patent [19]

Rapparini

[11] 4,450,669

[45] May 29, 1984

[54] LINE OF CONTINUOUS WORKING PACKAGING MACHINES FOR RECTANGULAR PRISMATIC PACKAGES

[76] Inventor: Gino Rapparini, Viale Roma 17, Bologna, Italy

[21] Appl. No.: 268,958

[22] Filed: Jun. 1, 1981

[30] Foreign Application Priority Data

Jun. 11, 1980 [IT] Italy ..... 3445 A/80

[51] Int. Cl.[3] ..... B65B 9/12; B65B 51/30

[52] U.S. Cl. ..... 53/551; 53/554

[58] Field of Search ..... 53/551, 552, 554, 548

[56] References Cited

U.S. PATENT DOCUMENTS

| | | | |
|---|---|---|---|
| 2,738,631 | 3/1956 | Järund | 53/551 |
| 2,962,843 | 12/1960 | Hoelzer et al. | 53/551 X |
| 2,966,021 | 12/1960 | Lane et al. | 53/552 |
| 3,006,121 | 10/1961 | Omori | 53/551 |
| 3,063,211 | 11/1962 | Graves | 53/551 X |
| 3,300,944 | 1/1967 | Thesing | 53/552 X |
| 3,320,718 | 5/1967 | Thesing | 53/551 |
| 3,388,525 | 6/1968 | Thesing et al. | 53/552 X |
| 3,528,214 | 9/1970 | Calvano | 53/551 X |
| 4,073,121 | 2/1978 | Greenawalt et al. | 53/552 X |

FOREIGN PATENT DOCUMENTS

| | | | |
|---|---|---|---|
| 1124865 | 3/1962 | Fed. Rep. of Germany | 53/551 |
| 41-7107515 | 11/1966 | Japan | 53/552 |
| 1025532 | 4/1966 | United Kingdom | 53/551 |

*Primary Examiner*—Horace M. Culver

*Attorney, Agent, or Firm*—Sughrue, Mion, Zinn, Macpeak, and Seas

[57] ABSTRACT

A continuous packaging machine is comprised of two opposed pairs of conveyors arranged to define an elongated passage having a rectangular cross section for the passage of a hollow packaging tube. The four belts are synchronized and run in the same direction. A plurality of first forming devices and a plurality of complementary sealing and crimping devices are alternately disposed on a first pair of opposed conveyors and a plurality of second forming devices and a plurality of shaping plates are alternately disposed on a second pair of opposed conveyors. As the tube is fed downwardly through the passage, the tube is crimped and sealed, the first and second forming devices and the shaping plates engage the tube while it is being filled to define a rectilinear prismatic package and the tube is then crimped and sealed by the next pair of devices to define a closed filled package. Cutters may be provided with the sealing devices to separate the closed packages.

2 Claims, 9 Drawing Figures

LINE OF CONTINUOUS WORKING PACKAGING MACHINES FOR RECTANGULAR PRISMATIC PACKAGES

BACKGROUND OF THE INVENTION

1. Field of the Invention

The invention relates to the technique of automatic packaging lines for production of filled and sealed packages, starting from a flat band stored on a reel.

2. Prior Art

Prior automatic packaging machines are known, which start from a flat band stored on a reel and produce edge packages, shaped by means of devices with complicated reciprocating motions.

The inevitable mechanical faults, due to the considerable dynamical stresses, arising from accelerations of heavy parts in reciprocating motion, limit the performances of the prior art packaging machines, so as to force them to be slow running.

Furthermore the known packaging machines in reciprocating motion have the disadvantage of high operating and maintenance expenses, due to the quickly wearing articulated joints of heavy parts in reciprocating motion which undergo considerable accelerations.

The accelerations, typical of the reciprocating motions, cause also intolerable noise inside the work rooms. The reciprocating packaging machines have the further inconvenience, that out-of-routine maintenance interventions are required frequently, and the consequence stopping of the whole automatic packaging line causes considerable production losses.

Furthermore, as known from the prior art, continuous working packaging lines can be used to produce pyramid-shaped packages. Nevertheless the modern trend of the users is toward rectangular prismatic packages, which can be easily handled and bulk packaged.

At the present time this trend is extending more and more and the range of application of rectangular prismatic packages is spreading over all kind of consumers' goods, as for example: milk even preservable, milk-cream, marmalade, drinks, fruit juice, oil even uneadible, fats, creams, generally pasty products, liquid or semiliquid, and every type of product suitable to be automatically packaged inside airtight, non-sterilized packages.

SUMMARY OF THE INVENTION

The aim of the invention is to provide an automatic high performance packaging line having safe running, easy minimal maintenance, noiseless operation, reduced running costs, reduced dimensions, and suitably both to the winding material and also to the product to be packaged while allowing adjustment and pre-dosing of the exact weight of product, as well as assembling of an eventual sterilizing plant upstream, and a bulk packaging plant downstream for the filled and sealed prismatic packages.

In order to overcome the prior art disadvantages an inventive effort has been required at a higher level than the average design capacity of a technician, skilled in the art of automatic packaging.

The invention, as evidenced by the present patent application, resulted in a continuous working high performance packaging line for rectangular prismatic packages which is noiseless, with low running expenses and minimal maintenance and with the highest degree of safety, accuracy and evenness.

The herein suggested continuous packaging line has industrial features much higher than the prior art ones and consists of a series of noiseless packaging machines operating at the highest speed and distinguishable by extrinsic and intrinsic innovations.

The inventive original features, peculiar to the above mentioned series of continuous moving, noiseless, high performance packaging machines for filled and sealed rectangular prismatic packages are essentially as described below:

(a) Four endless conveyors, in opposite pairs, synchronized and provided, alternately, with four forming devices, these last consisting of four squaring elements, in opposite pairs which, are arranged so as to shape internally segments of hollow prismatic tubes having a straight axis and rectangular section, noiseless by and continuous by sliding with a steady rectilinear motion.

(b) Alternating with the four squaring elements, the four endless opposite and synchronized conveyors are furtherly provided, in turns, with two pairs of operating devices, these last consisting of a pair of opposite sealing crimp jaws, equipped with cutting tools, and a pair of additional blades, one each side, in order to shape the side ears of the prismatic package, in the formation of the hollow segments of the continuous moving rectangular tube, meanwhile centering the picture, printed on the outside of the package already filled with the product to be packaged.

The present invention wil be more readily understood from the following embodiment, given merely by way of non-restrictive example, with reference to the drawings, wherein the main mechanisms are represented equipped with squaring groups alternating with the pairs of operating devices.

DETAILED DESCRIPTION OF THE INVENTION

Figure 2:
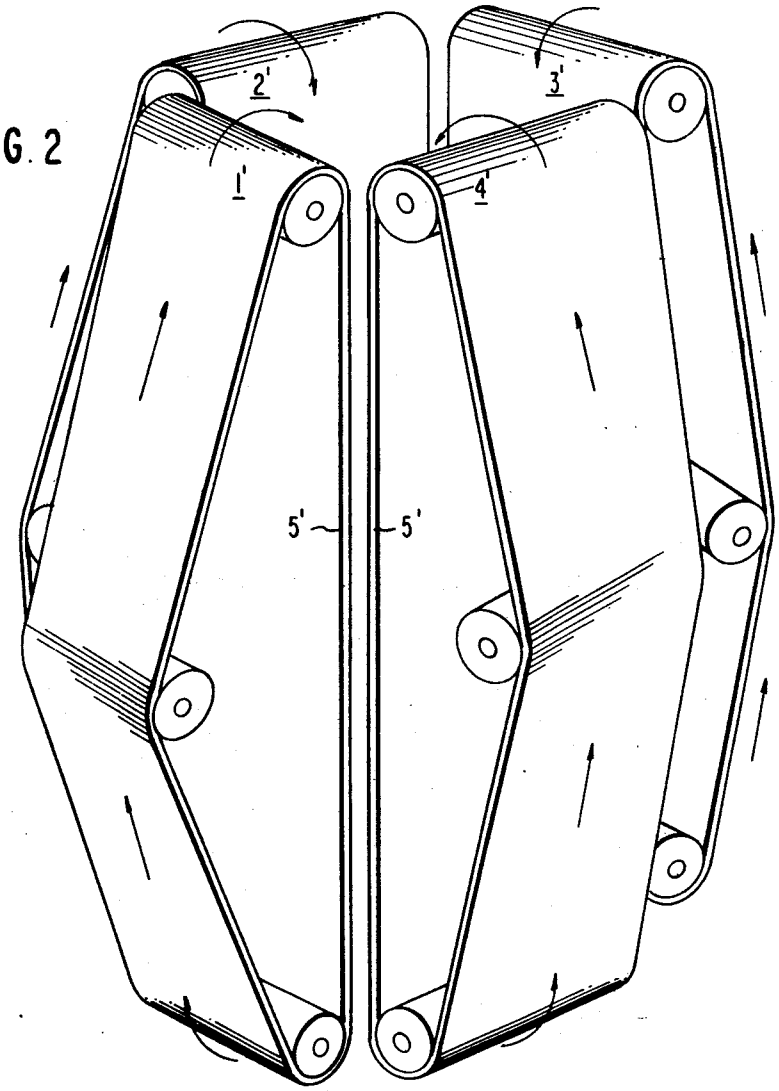
FIG. 2 is a modified schematic view of a set of conveyors 1', 2', 3', 4', provided with synchronized motion and following at least a rectilinear trajectory along the segments 5' with steady rectilinear motion.
Figure 1:
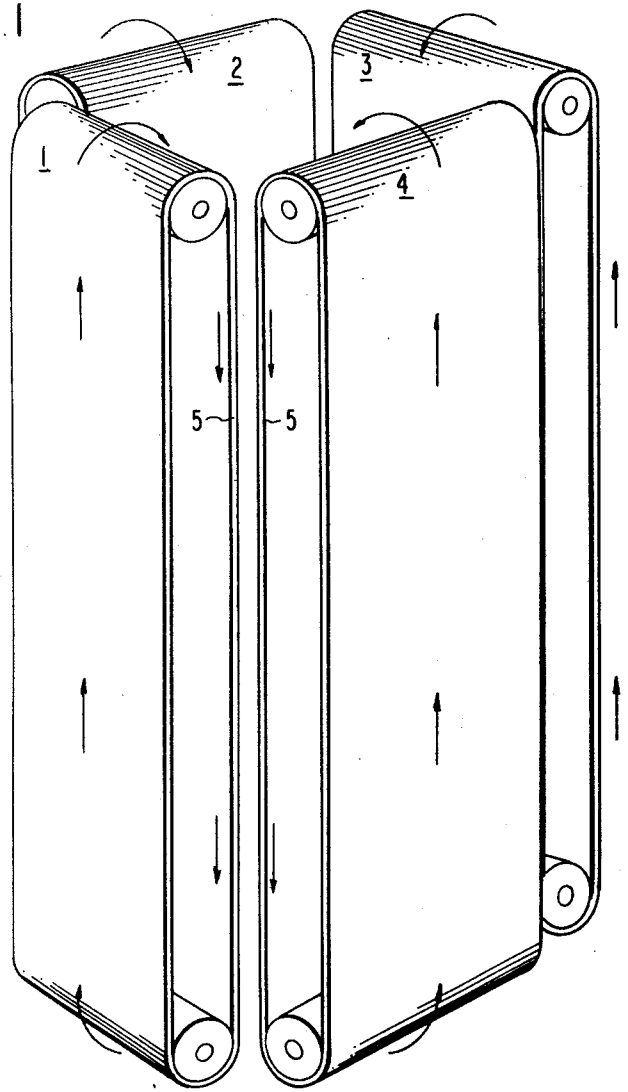
FIG. 1 is a schematical view of the main mechanisms, consisting of four endless conveyors 1,2,3,4 in opposing pairs. These ring-like conveyors, according to the invention, are provided with steady synchronized motion, as shown by the arrows, by means of known drive and transmission devices and the conveyor run is arranged, so that a segment of each of the conveyors presents a rectilinear trajectory, as referred to by the numbers 5.
Figure 4:
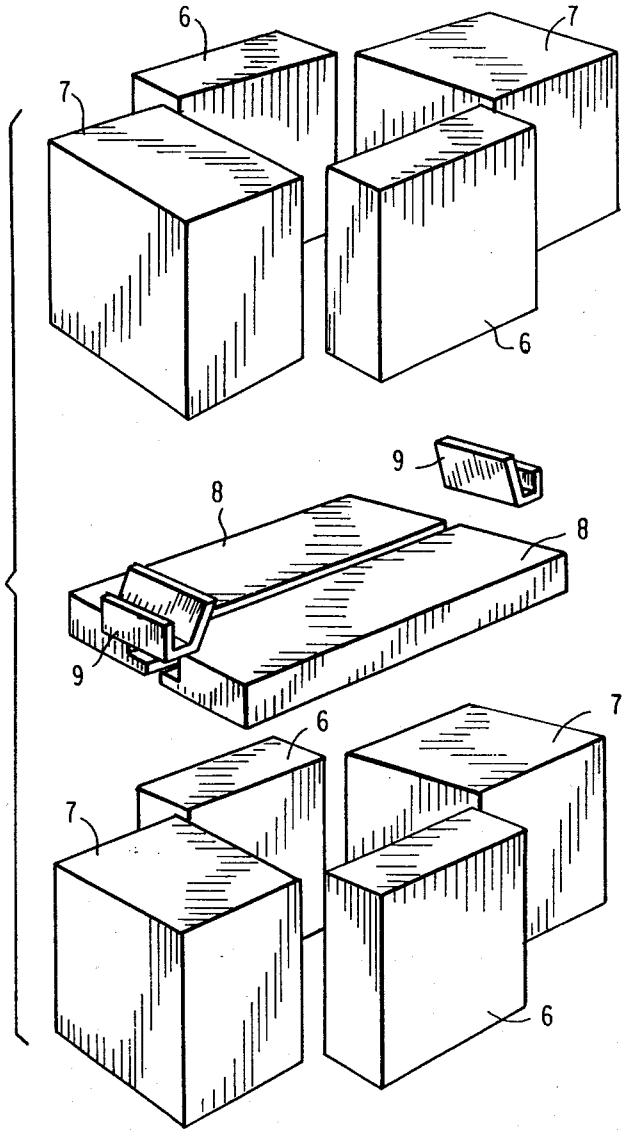
FIG. 4 is an exploded view without the conveyors showing forming devices 6 and 7, in opposing pairs to define a rectilinear segment, as well as alternately, disposed sealing crimp jaws 8, in order to carry out sealing and cutting, whereas the additional blades 9 operate sidewise, in order to shape the side ears of the package in the making as shown and described below.

As easily understanding from FIG. 1, the main mechanisms consist of four endless ring-shaped conveyors, in opposing pairs provided with synchronized steady motion by means of prior art drive and transmission devices (not shown).

In details the conveyor 1 is opposite to 3, and the conveyor 2 is opposite to 4.

All four conveyors move with synchronized steady motion and their steady speed rate can be very high, since the operation is noiseless, vibrationless, wearproof and maintenance-free.

In the various schematic views no drive or control mechanisms have been represented since this can be accomplished by means of systems known from the prior art.

With reference to the material to be used in practice, the above four conveyors may consist of chains joint links or fabric bands, even synthetic or the like.

Synchronization of steady motion of the four conveyors can be obtained by means of various known mechanisms, as, for instance, a row of equally spaced holes, or a row of stiffened pins, which will enter protuberances or holes suitably located on the drive and transmission rollers, so as to secure the perfect synchronization of steady motion between the conveyors.

For example the transmission belts inside the drive mechanisms of the engine timing system are known, as well as many other examples of transmission mechanisms, generally used on several known systems.

Of course, the above main mechanisms can slide inside suitable side guides of different forms and made of materials suitably choosen from among those reliable enough.

Thickness, width and height of the ring-shaped endless conveyors are parameters to be chosen by the skilled operator, according to the dimensioning of the packaging machines of this type, which can meet the technical and functional requirements of package to be carried out. Therefore their determination will fall within the average design capacity without requiring any further inventive effort.

After being acquainted with the original features and revealed inventive combinations of the main mechanisms, equipped with forming devices alternating with pairs of operating devices, any operator, skilled in the art of packaging, will be able to carry out an automatic packaging line, by means of an average design effort, in order to fill and seal rectangular prismatic packages with the above essentially described and illustrated invention.

Of course, the present invention admits of various practical executions with reference both to the dimensioning of main mechanisms, alternately equipped with forming and operating devices, and also to the technological choices of raw materials and use of suitable propulsion and control devices, while adhering to the basic principles.

Figure 3:
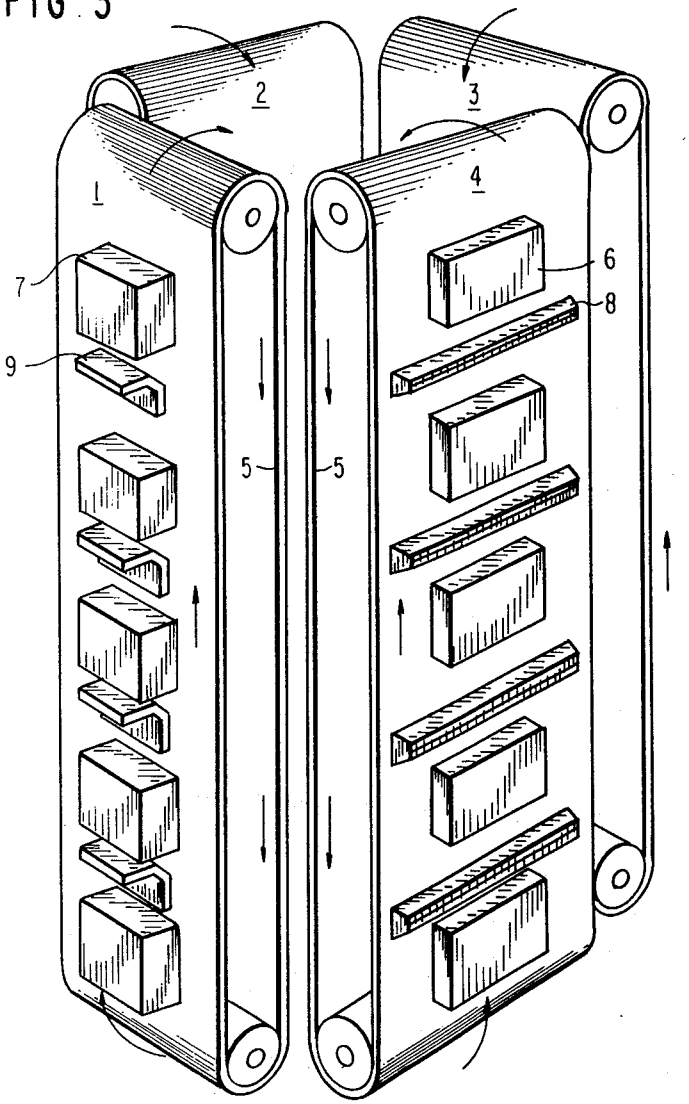
FIG. 3 shows the conveyors 2 and 4 alternately provided with forming devices 6 and sealing crimp jaws 8, whereas the conveyors 1 and 3 are alternately equipped with forming devices 7 and additional blades 9.

In the operation of the packaging machine a previously formed tube of material 10 is fed downwardly into the rectangular space defined between the four conveyors 1, 2, 3 and 4 as arranged in FIG. 3. As mentioned previously, the tube 10 is formed from a flat strip of material by suitable means (not shown) so that the upper end of the tube 10 will be open for the introduction of the material to be packaged.

Figure 5:
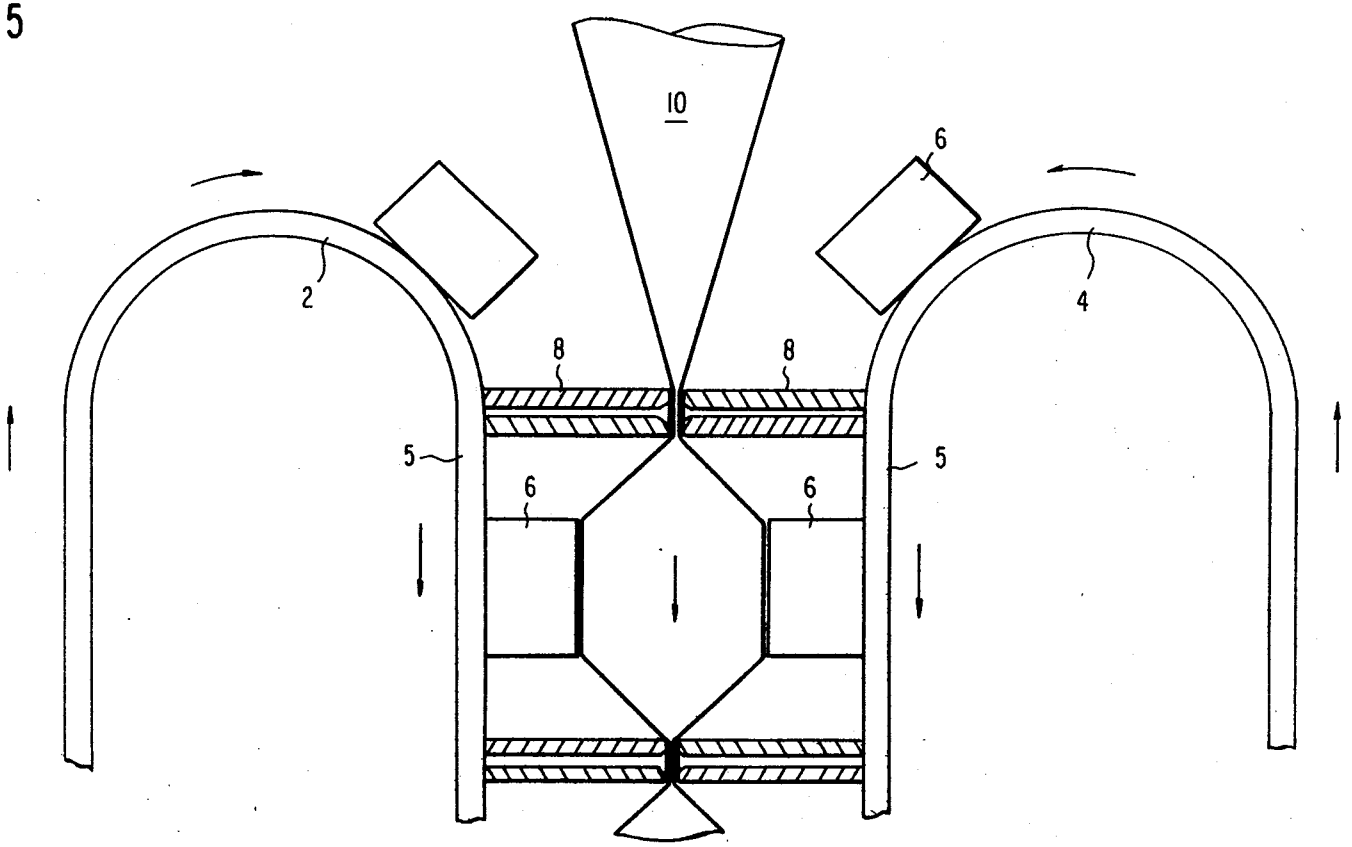
FIG. 5 is a schematic view showing that the crimp jaws 8 seal transversally the tube 10, already filled from above with the product to be packaged.
Figure 6:
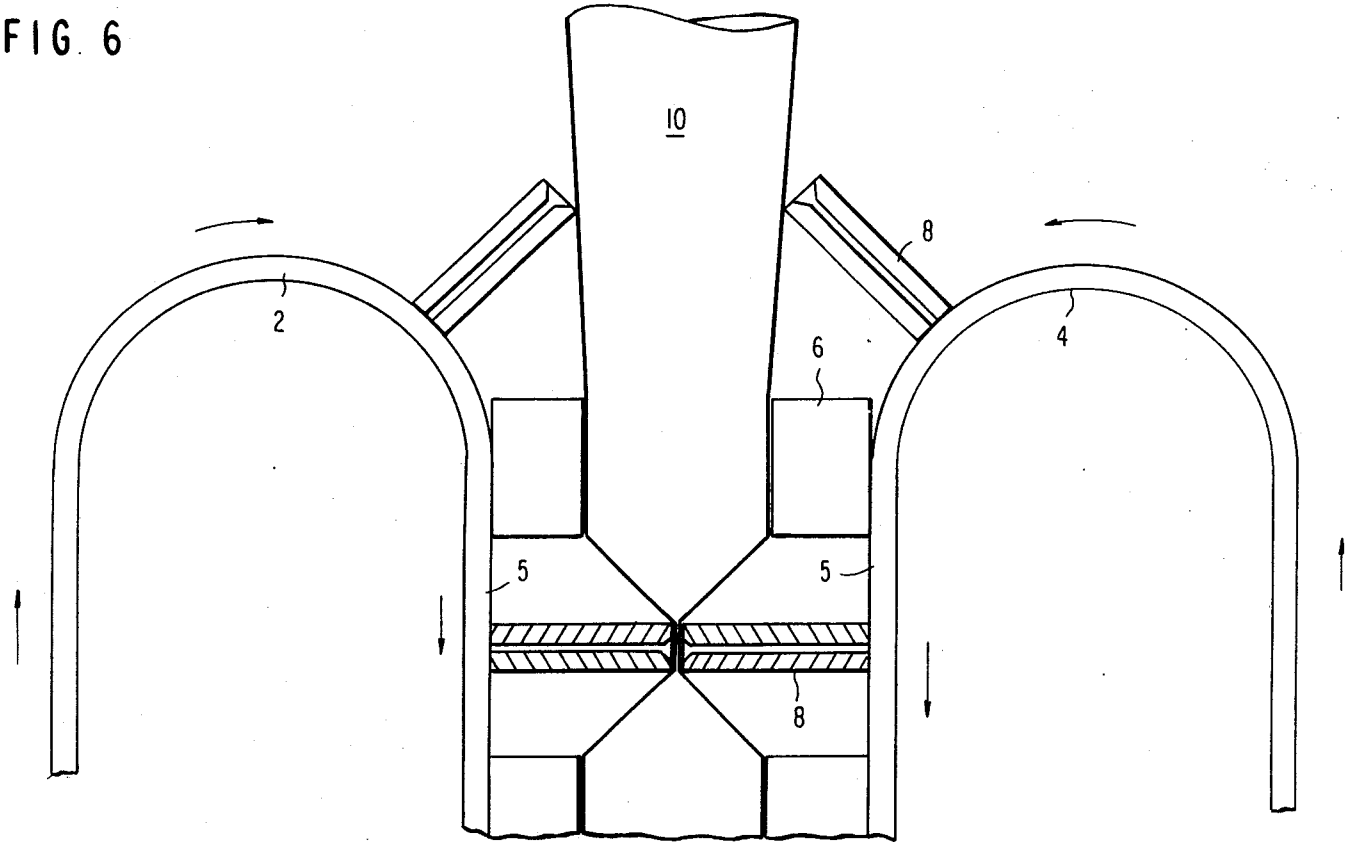
FIG. 6 is a schematic view similar to FIG. 5 with package 10, still opened on the top, in order to allow feeding of filling product, but already sealed on the bottom by the crimp jaws 8, which are pulling the package 10 downwardly with the rectilinear segment 5.
Figure 7:
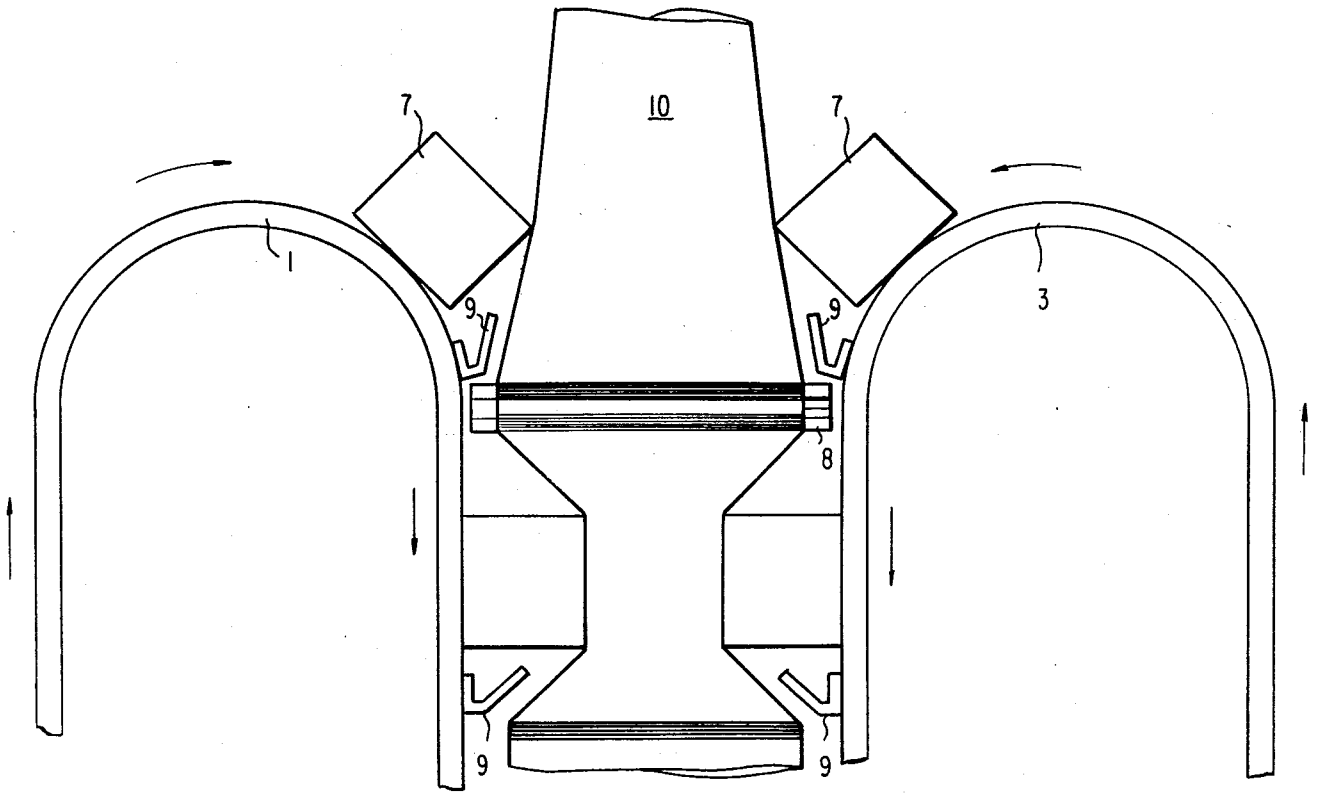
FIG. 7 is a schematic view showing the opposite conveyors 1 and 3, having alternating squaring elements 7 of additional blades 9, one each side, which operate on the side ears of the package 10 and at the same time allow centering of pictures printed outside the package.
Figure 8:
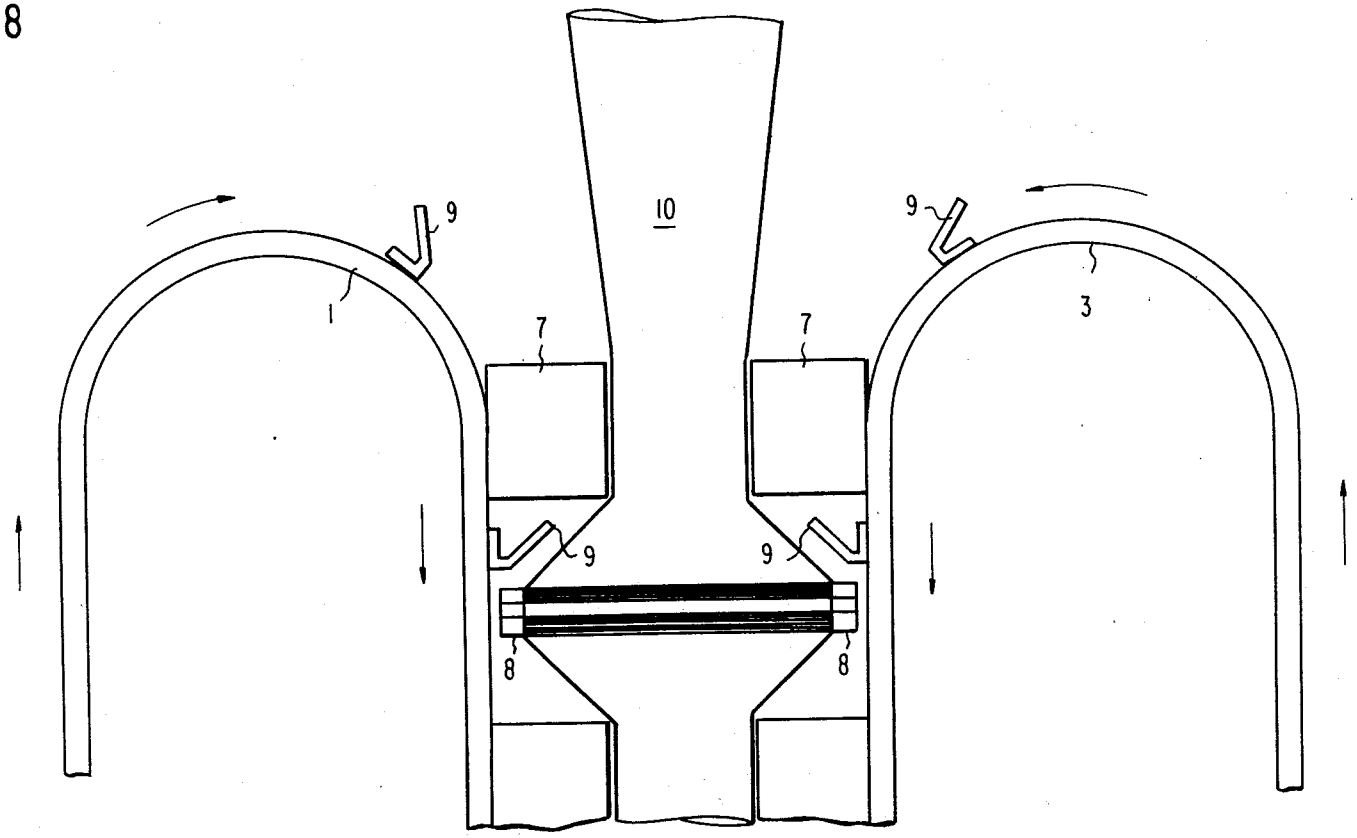
FIG. 8 is a schematic view similar to FIG. 7 when the package 10 is still open on the top, toward the feeding of the product to be packaged.

Since all four conveyors are moving in the direction of the arrows as shown in FIG. 3 and FIGS. 5-8, a pair of sealing and crimping elements 8 simultaneously engage the tube 10 to close the tube as shown in FIGS. 5 and 7. With the top of the tube 10 still open the tube will then be segmentally engaged by the forming plates 9 and the forming devices 6 and 7 to provide support for the tube during the filling of the tube with a predetermined change of material. Thus the filled portion of the tube 10 will have a configuration as shown in FIGS. 6 and 8 with the top of the tube 10 still open. Since the tube 10 is gripped by the elements 8 the tube 10 will be moved downwardly by the conveyors and the next set of sealing and crimping elements 8 on the conveyors 2 and 4 will engage the tube 10 to close the tube above the just filled portion to define a package.

Figure 9A:
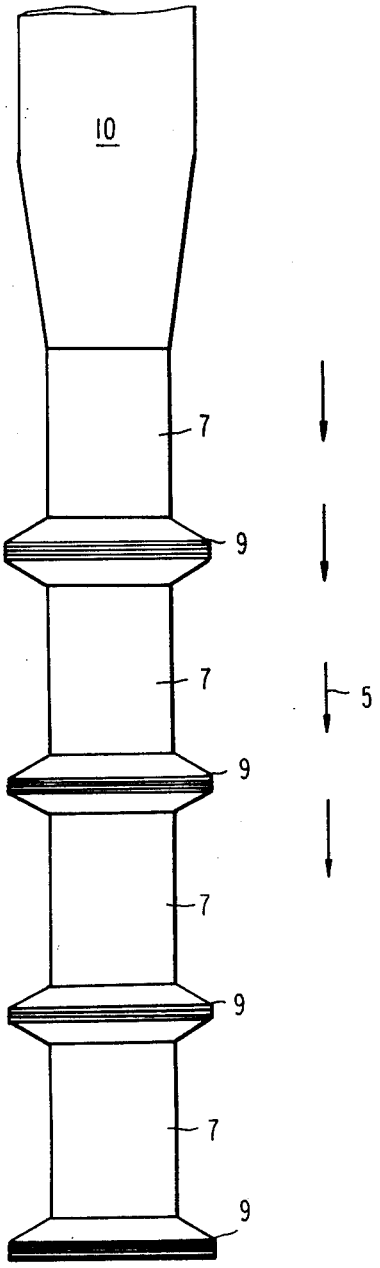
FIGS. 9*a* and 9*b* are schematic views taken 90° apart showing a series of filled and sealed containers moving in the direction of the arrows 5 with the numerals 6-9 indicating the portion of the various forming elements.
Figure 9B:
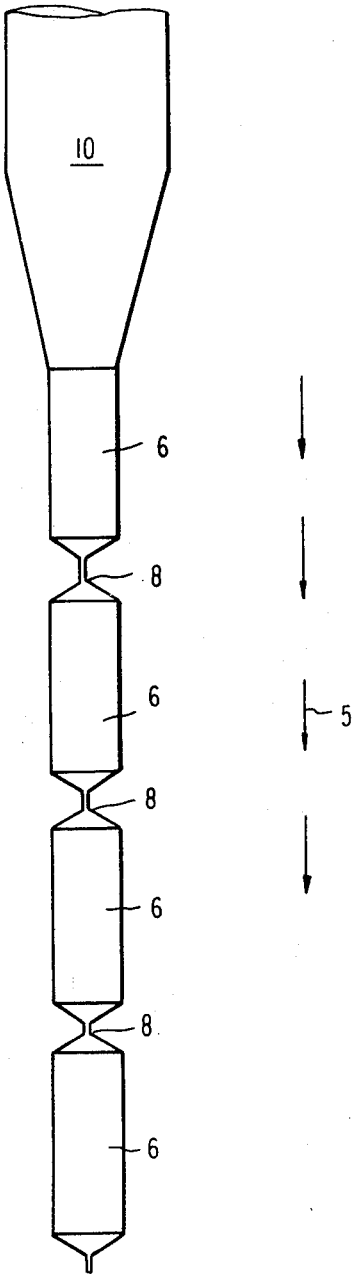

This sequence is continued to form a plurality of interconnected packages as shown in FIGS. 9*a* and 9*b*. Prior to release of the tube by the elements 8 at the bottom of the conveyor run 5, the cutting tools (not shown) associated with the sealing and crimping elements 8 can sever the individual packages from the tube 10. It is also possible to sever the package at a later time in a separate operation.

What we claim is:

1. A continuous packaging machine comprising four endless conveyor means moveable in synchronization in the same direction with each having a straight run portion, said conveyor means being disposed in a rectilinear configuration with said straight run portions of said conveyor means extending parallel to each other to define an elongated passage having a rectangular cross section for the passage of an elongated hollow tube, complementary package forming means secured to opposing pairs of conveyor means to provide support for the side of said tube during the introduction of a filling into said tube and complementary sealing and crimping means secured to two opposing conveyor means on opposite sides of said forming means in the direction of movement of said conveyor means for closing the tube to define a closed package.

2. A continuous packaging machine as set forth in claim 1 wherein each conveyor means in one pair of opposed conveyors is provided with a plurality of forming means and a plurality of crimping and sealing means which are secured to said conveyor means in alternating spaced relation and said other pair of opposing conveyor means is provided with a plurality of forming means and a plurality of end shaping plates secured to said conveyors in alternating spaced relation with said end shaping plates adapted to engage said tube intermediate said forming means and said sealing and crimping means.

* * * * *